United States Patent [19]

Weller

[11] Patent Number: 5,070,435

[45] Date of Patent: Dec. 3, 1991

[54] ILLUMINATED SCENIC GLASS

[76] Inventor: Harvey G. Weller, 613 S. Valley, New Ulm, Minn. 56073

[21] Appl. No.: 709,990

[22] Filed: Jun. 4, 1991

[51] Int. Cl.[5] ..... F21Y 33/00

[52] U.S. Cl. ..... 362/101; 362/32; 362/800

[58] Field of Search ..... 362/101, 800, 806, 32, 362/157; D7/507, 509, 514, 518, 521, 533, 536; D3/335

[56] References Cited

U.S. PATENT DOCUMENTS

| | | | |
|---|---|---|---|
| 919,691 | 4/1909 | Cahill | 362/101 |
| 3,218,447 | 11/1965 | Pardue | 362/101 |
| 3,374,344 | 3/1968 | Rudolph et al. | 362/101 |
| 3,735,113 | 5/1973 | Stott | 362/101 |
| 4,390,928 | 6/1983 | Runoe | 362/101 |
| 4,886,183 | 12/1989 | Fleming | 362/101 |

*Primary Examiner*—Ira S. Lazarus
*Assistant Examiner*—Richard R. Cole
*Attorney, Agent, or Firm*—Donald A. Jacobson

[57] ABSTRACT

A drinking glass with an upper cup and supporting stem uses light emitting diodes mounted in recesses the face of the cup in parallel with a light bulb mounted in the stem adjacent to the cup to provide illumination. A battery, switch and flasher mounted in the stem permits selection of on, off, or flashing options for this illumination. Designs can be cut into the face of the cup about any light emitting diode with fiber optics mounted within these designs to conduct light from the diode throughout the design.

5 Claims, 1 Drawing Sheet

ILLUMINATED SCENIC GLASS

FIELD OF THE INVENTION

This invention relates to improvements in a lighted beverage glass.

BACKGROUND OF THE INVENTION

A number of inventions have utilized incandescent bulbs in a variety of arrangements to light a beverage glass. These include U.S. Patents: Cahill U.S. Pat. No. 919,691; Stein U.S. Pat. No. 2,177,337; Moore U.S. Pat. No. 2,532,181; Simpson U.S. Pat. No. 2,663,866; Rudolph U.S. Pat. No. 3,374,344; Douglas U.S. Pat. No. 3,878,386; Runge U.S. Pat. No. 4,390,928; and Ditto et. al. U.S. Pat. No. 4,344,113. Stott U.S. Pat. No. 3,735,113 in addition to the incandescent illumination also provides a double walled bowl with a bundle of optical fibers which extend through the stem into the chamber between the walls to the incandescent bulb. These fibers only conduct light between the double walls of the bowl. These fibers are unrestrained within the double walls and therefore can only provide a generally random pattern because of their unrestrained free ends rather than a specific pattern.

SUMMARY OF THE INVENTION

A drinking glass has an upper cup supported by a hollow stem. Electrical components including a battery, switch, flasher unit, incandescent light bulb, and a light bulb holder are mounted in the hollow stem. The bulb is mounted immediately below the cup with the material between the light bulb and the cup interior being transparent to permit the light to shine into the cup from below. The switch used is a three-way single-pole switch which is mounted in the base of the stem and arranged to be operated from below. This switch is connected to the bulb, flasher and battery to provide the means to turn the light on or off, or have the light flash at periodic intervals. Wires from these electrical components in the stem extend through holes in the stem to the face of the cup, through grooves in the face of the cup to light emitting diodes mounted in mating recesses in the cup face. These light emitting diodes are wired and operate in parallel with the light bulb. Any desired design can be cut in the face of the cup to extend about a light emitting diode. These designs are enhanced by fiber optics secured to the face of the cup within the pattern. These fiber optics extend from the light emitting diodes throughout the figure and conduct light from the diodes throughout the designs.

DETAILED DESCRIPTION OF THE PREFERRED EMBODIMENT

Figure 1:
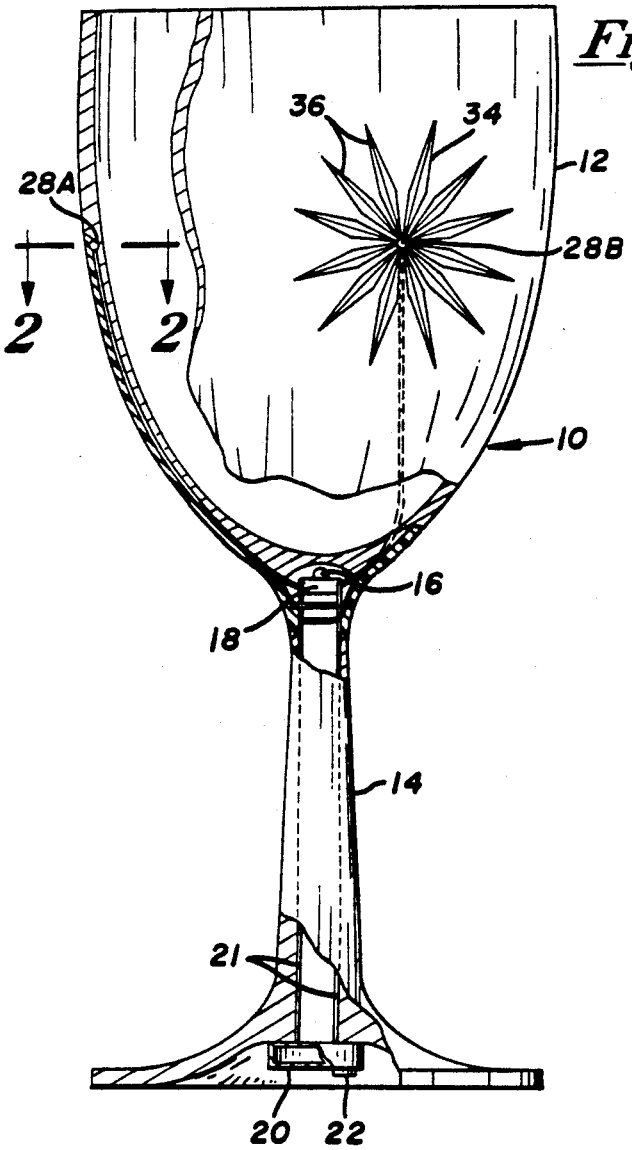
FIG. 1 is a side view of the glass with cut-out areas showing portions of the cup face, stem top, and portions of the stem.

An illuminated scenic glass 10 consisting of a cup 12 and stem 14 is shown in FIG. 1. Stem 14 is hollow and contains an incandescent light bulb 16 mounted in holder 18, and an electrical component holder 20. The wires between holder 18 and electrical component holder 20 are rigid to allow inserting holder 18 into hollow stem 14 as an assembly.

Figure 3:
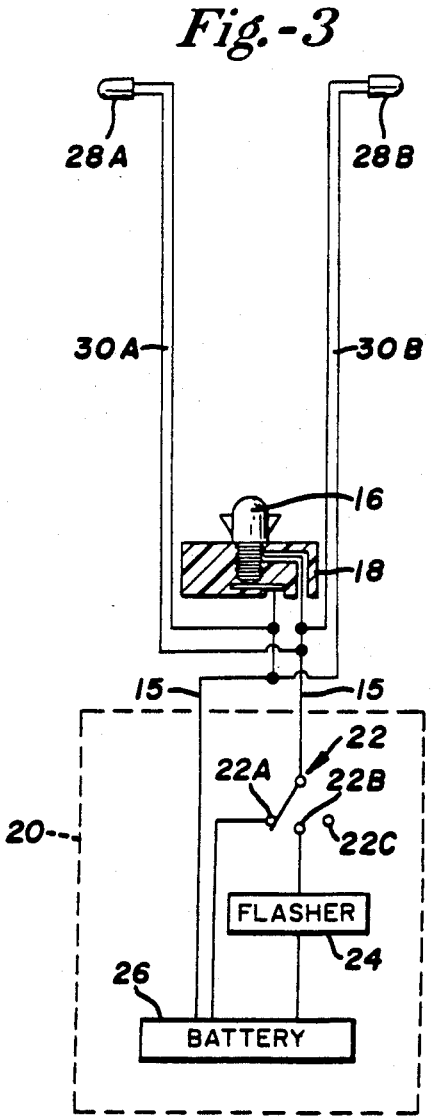
FIG. 3 is the electrical circuit diagram.

The electrical circuit diagram in FIG. 3 shows the electrical circuits with the components contained in holder 20 shown within the dashed outline. Holder 20 contains a single pole three position switch 22, a flasher 24 and a battery 26. Flasher 24 is a conventional flasher unit matched to battery 26 and light bulb 16 such that the flasher will cause the light bulb to operate intermittently.

Light emitting diodes 28A and 28B are connected in parallel with light bulb 16 by respective pairs of wires 30A and 30B. Wires 30A and 30B are routed from the diodes through recesses cut in the face of cup 12 to stem 14, and thence through holes in the walls of the stem into the hollow interior. Wires 30A and 30B extending to diodes 28A and 28B respectively are extremely fine and flexible to provide an inconspicuous electrical connection and to permit threading these wires through holes in stem 14 when holder 18 is inserted in place.

Figure 2:
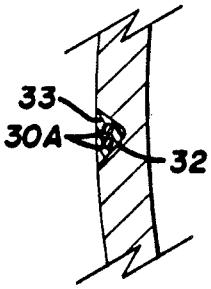
FIG. 2 is the cross-section of 2—2 taken from FIG. 1.

In FIG. 2 the routing of wires 30A along a V-shaped groove 32 cut into the face of cup 12 is shown. Groove 32 and the hole into the center of stem 14 are filled with a conventional transparent two-part plastic epoxy to both hold the wires in place and to provide a smooth outer surface for glass 10.

A design 34, shown in FIG. 1, in the general shape of a flower is cut into the face of cup 12. Fiber optics 36 mounted within design 34 extend from light emitting diode 28B down the center of and to the end of each respective petal. Fiber optics 36 are secured in place within design 34 using a two-part epoxy in the same manner as wires 30A and 30B. Wires 30B extend through a groove which has the same shape as groove 32A and are secured by a two part epoxy in the same manner as wires 32A.

Switch 22 has three contacts 22A, 22B and 22C. With switch 22 switched to contact 22A, bulb 16, and diodes 28A and 28B are connected across battery 26 to provide a steady light output With switch 22 switched to contact 22B, then bulb 16 and diodes 28A and 28B are connected to battery 26 through flasher 24 to provide an intermittent flashing light output. With switch 22 switched to contact 22C, this is the off position.

In FIG. 1, diode 28A has no figure outlined about the diode, while diode 28B has a figure outlined about the diode as shown. Fiber optics 36 extend from diode 28B and are arranged to be illuminated by the diode to provide a lighted center for each petal of FIG. 34. This illustrates the various approaches which can be used to illuminate the face of cup 12 by using diodes mounted on the face of the cup either with or without a figure cut into the surface of the cup.

A great variety of arrangements are possible using different figures, different fiber optic configurations and light emitting diodes either with or without fiber optics. This variety is a addition to the light bulb which always operates in parallel with the light emitting diodes. The addition of a flasher option also greatly enhances the appeal of the glass because of the great attention getting capability of a flashing light. Stem 14 is normally made of opaque material or covered with opaque material to conceal the electrical components mounted within.

These features can be selected and intermixed as desired to produce a great number of different enhanced figures. While this invention has been described with reference to an illustrative embodiment, this description is not intended to be construed in a limiting sense. Various modifications of the illustrative embodiment, as well as other embodiments of the invention, will be apparent to persons skilled in the art upon reference to this description. It is therefore contemplated that the appended claims will cover any such modifications or embodiments as fall within the true scope of the invention.

What is claimed is:

1. An illuminated drinking glass comprising:

(a) a cup having a hollow supporting stem, an upper portion of the cup adjacent to the stem being transparent and having an outer face; and (b) incandescent illuminating means for illuminating the upper cup, said illuminating means being mounted within the hollow stem adjacent to said cup such as to illuminate the cup through the transparent portion; and (c) the cup having at least one recess in the face with the recess having a light emitting diode mounted therein; and (d) battery means, flasher means and switching means connected for selecting intermittent and continuous power to said incandescent illuminating means and said light emitting diode, said switching means being mounted within said hollow stem such as to be operable through the hollow stem.

2. Apparatus as in claim 1 and further comprising first grooves in the face of the cup extending from said light emitting diodes to the stem, and having a hole communicating with said first grooves extending from said first grooves to an interior of the hollow stem, and having pairs of flexible wires connected to each said light emitting diodes and leading through said first grooves through said communicating holes into the interior of said hollow stem arranged such as to provide energy to said light emitting diode, and having epoxy means filling each said first grooves for covering and attaching said flexible wires within said groove.

3. Apparatus as in claim 1 and further comprising a number of second grooves in the outer face of said cup, each second groove extending outward from said light emitting diode and having a strand of fiber optics extending outward along said groove from said light emitting diode, and having a transparent epoxy filling said second grooves to secure said fiber optics strand in place.

4. Apparatus as in claim 3 and further comprising a figure cut into the face of said cup about each groove extending outward from said light emitting diode such that each figure encloses said fiber optics and is illuminated thereby.

5. Apparatus as in claim whereby said switching means comprises a single pole three position switch having a first selection position connecting the battery means directly to the illumination means and light emitting diode, having a second selection selection position connecting the battery means through the flasher means to the illumination means and light emitting diode means, and having a third selection position to disconnect the battery means from the illumination means and the light emitting diode means.

* * * * *